US012569725B1

(12) United States Patent
Power et al.

(10) Patent No.: US 12,569,725 B1
(45) Date of Patent: Mar. 10, 2026

(54) IRON-TYPE GOLF CLUB HEAD WITH IMPROVED EXIT CHANNEL FOR HOSEL ADJUSTABILITY FEATURES

(71) Applicant: Callaway Golf Company, Carlsbad, CA (US)

(72) Inventors: Alex Power, Carlsbad, CA (US); Joshua D. Westrum, Carlsbad, CA (US); Matthew Myers, Carlsbad, CA (US); Patrick C. Davis, Carlsbad, CA (US); Scott Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 750 days.

(21) Appl. No.: 17/874,900

(22) Filed: Jul. 27, 2022

Related U.S. Application Data

(60) Provisional application No. 63/226,108, filed on Jul. 27, 2021.

(51) Int. Cl.
*A63B 53/00* (2015.01)
*A63B 53/02* (2015.01)
*A63B 53/04* (2015.01)

(52) U.S. Cl.
CPC ..... *A63B 53/023* (2020.08); *A63B 53/047* (2013.01); *A63B 2053/0479* (2013.01)

(58) Field of Classification Search
CPC ..... A63B 53/023; A63B 53/047; A63B 2053/0479; A63B 53/00–14; A63B 2102/32
USPC ..... 473/282–350
See application file for complete search history.

(56) References Cited

U.S. PATENT DOCUMENTS 1,137,457 A * 4/1915 Breitenbaugh ..... A63B 53/06 403/97
2,067,556 A * 1/1937 Wettlaufer ..... A63B 60/00 473/308
2,091,794 A * 8/1937 Pester ..... A63B 60/00 403/107
2,326,495 A * 8/1943 Reenstierna ..... A63B 53/06 D21/734
2,332,342 A * 10/1943 Reach ..... A63B 53/047 473/248
2,847,219 A * 8/1958 Shoemaker ..... A63B 53/02 473/247

(Continued)

FOREIGN PATENT DOCUMENTS

CN 103877711 A * 6/2014 ..... A63B 53/02
GB 2241173 A * 8/1991 ..... A63B 53/02

(Continued)

*Primary Examiner* — Kiley S Stoner
(74) *Attorney, Agent, or Firm* — Michael A. Catania

(57) ABSTRACT

An iron-type golf club head with a hosel, a hosel bore, and an exit channel in communication with the hosel bore that is offset from and extends at an angle of up to 15 degrees with respect to the hosel bore is disclosed herein. The exit channel does not extend into the face or sole of the golf club head, thereby preserving the structural integrity and aesthetics of the golf club while permitting the use of adjustable hosel features that allow for easy adjustments to the loft and lie of the club head. This feature may be used in connection with any type of irons, including wedges.

2 Claims, 5 Drawing Sheets

(56) References Cited

U.S. PATENT DOCUMENTS 4,995,609 A * 2/1991 Parente ..... A63B 53/00 473/291
5,067,711 A * 11/1991 Parente ..... A63B 53/00 473/291
5,133,553 A * 7/1992 Divnick ..... A63B 53/02 403/97
5,222,734 A * 6/1993 Parente ..... A63B 53/00 473/305
5,320,347 A * 6/1994 Parente ..... A63B 53/00 473/305
6,120,384 A * 9/2000 Drake ..... A63B 60/00 473/409
8,727,899 B1 * 5/2014 Galloway ..... A63B 53/02 473/288
8,753,221 B1 * 6/2014 Aguinaldo ..... A63B 53/06 473/307
9,144,719 B1 * 9/2015 Vrska ..... A63B 53/02
9,144,720 B1 * 9/2015 Vrska ..... A63B 53/02
9,694,262 B1 * 7/2017 Myers ..... A63B 53/02
9,802,089 B2 * 10/2017 Honea ..... A63B 60/02
9,814,944 B1 * 11/2017 Greaney ..... A63B 53/0466
10,195,497 B1 * 2/2019 Greaney ..... A63B 60/002
10,716,972 B1 * 7/2020 Holtzman ..... A63B 53/0466
2009/0233728 A1 * 9/2009 Liou ..... A63B 53/02 473/307
2009/0286611 A1 * 11/2009 Beach ..... A63B 53/06 473/335
2009/0286619 A1 * 11/2009 Beach ..... A63B 53/0466 473/307
2010/0069170 A1 * 3/2010 Bennett ..... A63B 53/02 473/307
2010/0197424 A1 * 8/2010 Beach ..... A63B 60/02 473/307
2011/0118045 A1 * 5/2011 Sato ..... A63B 60/00 473/307
2011/0152000 A1 * 6/2011 Sargent ..... A63B 60/00 473/345
2011/0177876 A1 * 7/2011 Bennett ..... A63B 53/047 473/307
2011/0312437 A1 * 12/2011 Sargent ..... A63B 53/06 473/335
2012/0034994 A1 * 2/2012 Knutson ..... A63B 53/02 473/307
2012/0071262 A1 * 3/2012 Beach ..... A63B 60/00 473/307
2012/0100926 A1 * 4/2012 Golden ..... A63B 53/0466 473/307
2012/0122601 A1 * 5/2012 Beach ..... A63B 60/00 473/324
2012/0142445 A1 * 6/2012 Burnett ..... A63B 53/0466 473/307
2012/0316006 A1 * 12/2012 Kitagawa ..... A63B 53/0466 473/307
2013/0085010 A1 * 4/2013 Beach ..... A63B 53/02 473/307
2013/0116062 A1 * 5/2013 Zimmerman ..... A63B 53/02 473/307
2013/0184098 A1 * 7/2013 Boyd ..... A63B 53/02 473/307
2013/0210542 A1 * 8/2013 Harbert ..... A63B 53/06 473/338
2013/0344979 A1 * 12/2013 Golden ..... A63B 60/42 473/307
2014/0031139 A1 * 1/2014 Johnson ..... A63B 53/0466 473/307
2014/0080629 A1 * 3/2014 Sargent ..... A63B 60/00 473/336
2014/0121035 A1 * 5/2014 Nivanh ..... A63B 53/0466 473/309
2014/0256461 A1 * 9/2014 Beach ..... A63B 53/02 473/244
2014/0274446 A1 * 9/2014 Greaney ..... A63B 53/06 473/307
2015/0018116 A1 * 1/2015 Zimmerman ..... A63B 53/047 473/307
2015/0367185 A1 * 12/2015 Vrska ..... G09F 23/0066 473/305
2015/0367186 A1 * 12/2015 Vrska ..... A63B 53/0466 473/314
2015/0375065 A1 * 12/2015 Beach ..... A63B 60/00 473/409
2016/0001146 A1 * 1/2016 Sargent ..... A63B 53/06 473/336
2016/0023061 A1 * 1/2016 Beach ..... A63B 53/02 473/307
2016/0059093 A1 * 3/2016 Nielson ..... A63B 53/02 473/338
2016/0059094 A1 * 3/2016 Mata ..... A63B 53/06 473/329
2016/0129320 A1 * 5/2016 Dolezel ..... A63B 53/0487 473/329
2016/0166894 A1 * 6/2016 Curtis ..... A63B 60/42 473/324
2016/0184662 A1 * 6/2016 Barelmann ..... A63B 53/02 473/307
2016/0243411 A1 * 8/2016 Knutson ..... A63B 53/02
2016/0263448 A1 * 9/2016 Bennett ..... A63B 53/02
2016/0332039 A1 * 11/2016 Tassistro ..... A63B 53/0466
2016/0354648 A1 * 12/2016 Beach ..... A63B 53/0466
2017/0252613 A1 * 9/2017 Daraskavich ..... A63B 53/0475
2017/0266518 A1 * 9/2017 Beach ..... A63B 60/00
2018/0028877 A1 * 2/2018 Bennett ..... A63B 53/047
2018/0065003 A1 * 3/2018 Greaney ..... A63B 53/0466
2018/0154224 A1 * 6/2018 Bovee ..... A63B 53/0466
2018/0161650 A1 * 6/2018 Beach ..... A63B 60/00
2018/0189758 A1 * 7/2018 Beach ..... A63B 53/047
2018/0200590 A1 * 7/2018 Evans ..... A63B 53/06
2018/0318661 A1 * 11/2018 Greaney ..... A63B 60/00
2019/0076705 A1 * 3/2019 Greaney ..... A63B 53/04
2019/0105545 A1 * 4/2019 Beach ..... A63B 53/06
2019/0381370 A1 * 12/2019 Greaney ..... A63B 53/08
2020/0360771 A1 * 11/2020 Greer ..... A63B 53/0466
2021/0291025 A1 * 9/2021 Hebreo ..... A63B 53/0416
2021/0322838 A1 * 10/2021 Willett ..... F15D 1/10
2021/0387064 A1 * 12/2021 Nielson ..... A63B 53/0412
2022/0032131 A1 * 2/2022 Oldknow ..... A01H 6/1472
2022/0118321 A1 * 4/2022 Issertell ..... A63B 53/047
2022/0184475 A1 * 6/2022 Hebreo ..... A63B 53/045
2023/0149782 A1 * 5/2023 Greer ..... A63B 53/0466 473/307
2023/0158371 A1 * 5/2023 Greer ..... A63B 53/047 473/307
2024/0082659 A1 * 3/2024 Daraskavich ..... A63B 53/0475
2025/0041677 A1 * 2/2025 Beach ..... A63B 53/06

FOREIGN PATENT DOCUMENTS

GB 2496274 A * 5/2013 ..... A63B 53/00
JP 2001509718 A * 7/2001
JP 4671447 B1 * 4/2011 ..... A63B 53/02
JP 2015100704 A * 6/2015 ..... A63B 53/0408
JP 2016129695 A * 7/2016 ..... A63B 53/00
KR 100412931 B1 * 12/2003
KR 101404729 B1 * 6/2014
KR 20210045913 A * 4/2021
KR 20210121233 A * 10/2021
WO WO-2012064707 A1 * 5/2012 ..... A63B 53/02
WO WO-2012088618 A1 * 7/2012 ..... A63B 53/005
WO WO-2013028885 A2 * 2/2013 ..... A63B 53/02
WO WO-2013122885 A2 * 8/2013 ..... A63B 53/02
WO WO-2014070343 A1 * 5/2014 ..... A63B 53/04
WO WO-2014070904 A1 * 5/2014 ..... A63B 53/02
WO WO-2017120389 A1 * 7/2017 ..... A63B 53/02
WO WO-2021022219 A1 * 2/2021 ..... A63B 53/02
WO WO-2022081640 A1 * 4/2022 ..... A63B 53/027

* cited by examiner

IRON-TYPE GOLF CLUB HEAD WITH IMPROVED EXIT CHANNEL FOR HOSEL ADJUSTABILITY FEATURES

CROSS REFERENCES TO RELATED APPLICATIONS

The present application claims priority to U.S. Provisional Application No. 63/226,108, filed on Jul. 27, 2021, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to an iron-type golf club head with an improved hosel exit channel structure that allows adjustments to be made to loft and lie angles of the iron without negatively affecting its performance or aesthetics.

Description of the Related Art

The prior art discloses many different adjustable hosel designs that allow for adjustment of lie and/or loft angles of a wood-type golf club head. These prior art designs permit off-axis orientation of an adjustable hosel assembly (e.g., shaft, shaft sleeve) within the hosel bore itself, which assembly is affixed to the hosel with a mechanical fastener 40 such as a bolt or screw. The problem with these designs, however, lies in the fact that they are not readily translatable to iron-type golf club heads, including wedges. As shown in FIGS. 1-3, applying prior art adjustable hosel 20 structures to iron-type club heads 10 creates exit channels 22 that interfere with or otherwise affect the sole 30 and face 35 surfaces, leading to increased breakage and suboptimal aesthetics. For example, when the exit channel 22 is aligned with both the lie angle and the loft angle of the hosel 20, as shown in FIG. 1, the channel 22 cuts into the sole and the face and interferes with the leading edge 32 of the iron body. When the exit channel 22 is aligned with the lie angle of the hosel 20 but offset from the loft angle of the hosel 20, as shown in FIGS. 2 and 3, the exit channel still cuts into the sole. In both of these configurations, the dimensions of the iron head 10 are such that the exit channel 22 cuts deeply into the body 15, creating openings 23 into the hollow portions of the club head if the club 10 is hollow and divots if the club 10 is solid. In addition to being unsightly, these openings result in breakage and permit debris to enter the interior of the body. Therefore, there is a need for an improved adjustable hosel design for iron-type golf club heads.

BRIEF SUMMARY OF THE INVENTION

One aspect of the present invention is an iron-type golf club head configured to receive an adjustable hosel assembly, the iron-type golf club head comprising a hosel with an exit channel in a heel side of the head that is angled up to 15 degrees from one or both of a hosel loft and lie axis.

Another aspect of the present invention is an iron-type golf club head comprising a hosel comprising a hosel bore, a through hole, and a hosel axis, a face, a topline, a sole, and a heel section comprising an exit channel, wherein the exit channel comprises a channel axis, wherein the exit channel is in communication with the through hole and the hosel bore, and wherein the channel axis is offset from and extends at an angle with respect to the hosel axis. In some embodiments, the angle may be no less than 1 degree and no more than 15 degrees, and in a further embodiment, may be approximately 10 degrees. In other embodiments, the exit channel may not extend into the sole or the face. In any embodiment, the iron-type golf club head may be selected from the group consisting of a wedge, a blade iron, a hollow iron, and a cavity-back iron.

Yet another aspect of the present invention is an assembly comprising an iron-type golf club head comprising a face, a rear surface, a sole, a topline, a heel section, a hosel, a hosel bore, a flange encircling a through-hole, and an exit channel, a mechanical fastener comprising a fastener head with a first set of engagement features and an elongated body, and an adjustment tool comprising a tool head with a second set of engagement features sized to engage with the first set of engagement features, wherein the hosel bore has a first axis, wherein the exit channel has a second axis, and wherein the second axis extends at a channel angle of no more than 15 degrees with respect to the first axis, wherein the mechanical fastener is sized to fit within the exit channel so that the elongated body extends through the through hole and the fastener head abuts the flange, and wherein the tool head is sized to fit within the exit channel and engage with the fastener head.

In some embodiments, exit channel may be disposed entirely within the heel section and may not extend into the sole or the face. In any embodiment, the iron-type golf club head may be selected from the group consisting of a wedge, a blade iron, a hollow iron, and a cavity-back iron. In a further embodiment, the iron-type golf club head may be a wedge selected from the group consisting of a pitching wedge, a gap wedge, a sand wedge, and a lob wedge. In other embodiments, the second axis may extend at an angle of approximately 10 degrees with respect to the first axis. In still other embodiments, the tool head may have a hexagonal shape. In a further embodiment, the tool heed may comprise a tool axis, at least one edge that is angled with respect to the tool axis, and at least one relief cut. In a further embodiment, the at least one edge may extend at an edge angle of up to 15 degrees with respect to the tool axis, and may be approximately equivalent to the channel angle. In another embodiment, the tool head may comprise a plurality of relief cuts.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
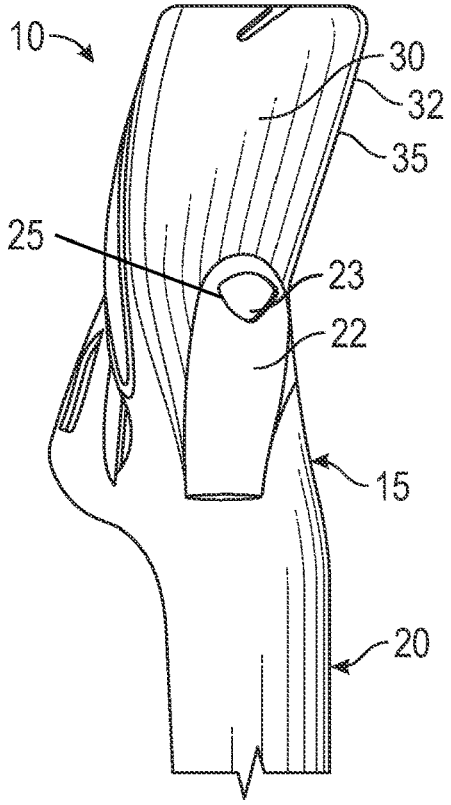
FIGS. 1-3 are perspective views of iron-type golf club heads incorporating hosel exit channels found in prior art adjustable hosel designs.
Figure 2:
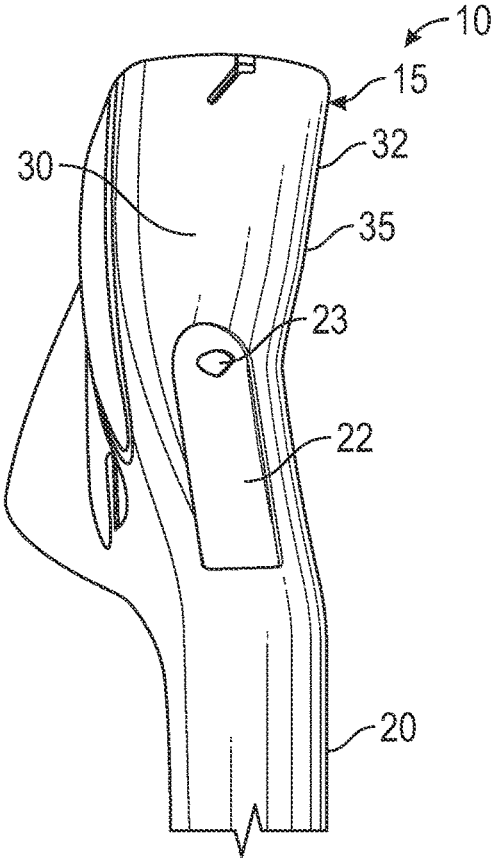
Figure 3:
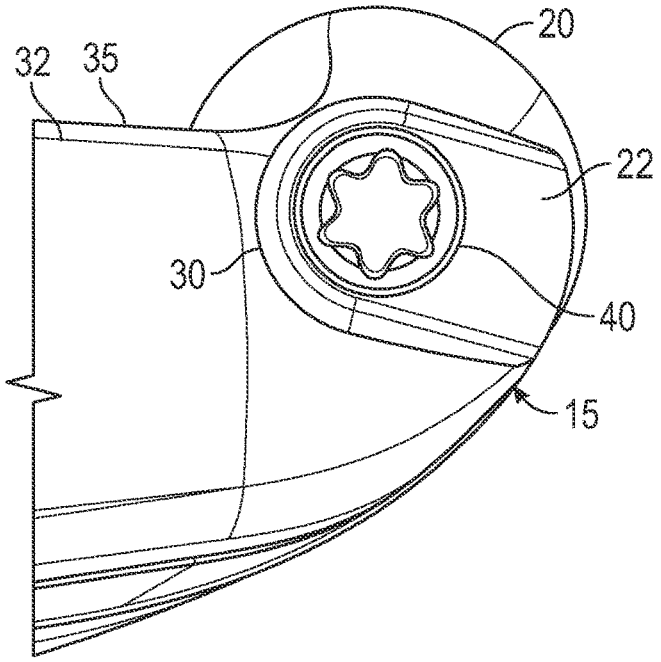
Figure 4:
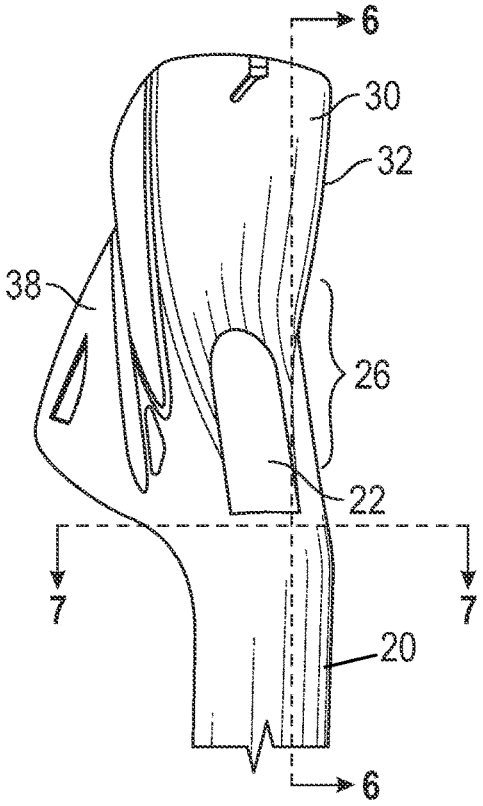
FIG. 4 is a heel-side perspective view of a golf club head of the present invention.
Figure 5:
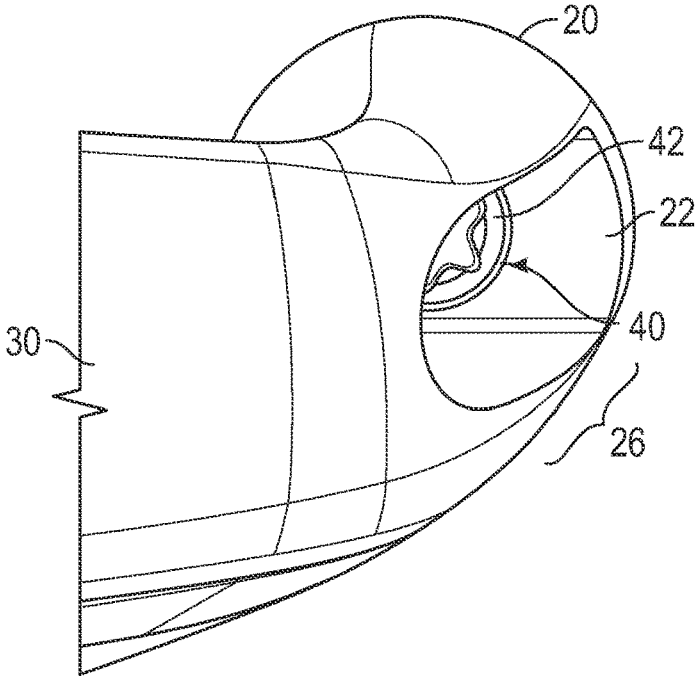
FIG. 5 is a sole elevational view of the embodiment shown in FIG. 4.

The preferred embodiment of the present invention, shown in FIGS. 4-11, is an iron-type golf club head 10 comprising a hosel 20, a heel section 26 beneath the hosel, sole 30 configured to contact turf during play, a leading edge 32, a face 35 configured contact a golf ball, a topline 36, and a rear surface 38. The iron head 10 is configured to receive an adjustable hosel assembly (not shown), as the hosel 20 has a bore 21 with a flange 25 surrounding a through-hole 23 in communication with a hosel exit channel 22 disposed in the heel section 26. The bore 21 follows a hosel axis 12, which defines the loft and lie of the head 10, while the exit channel 22 is angled (or off-axis) with respect to the hosel axis 12. A mechanical fastener 40 such as a bolt or screw is placed into the exit channel 22 to engage with the adjustable hosel assembly and temporarily fix a shaft to the iron club head 10.

Figure 6:
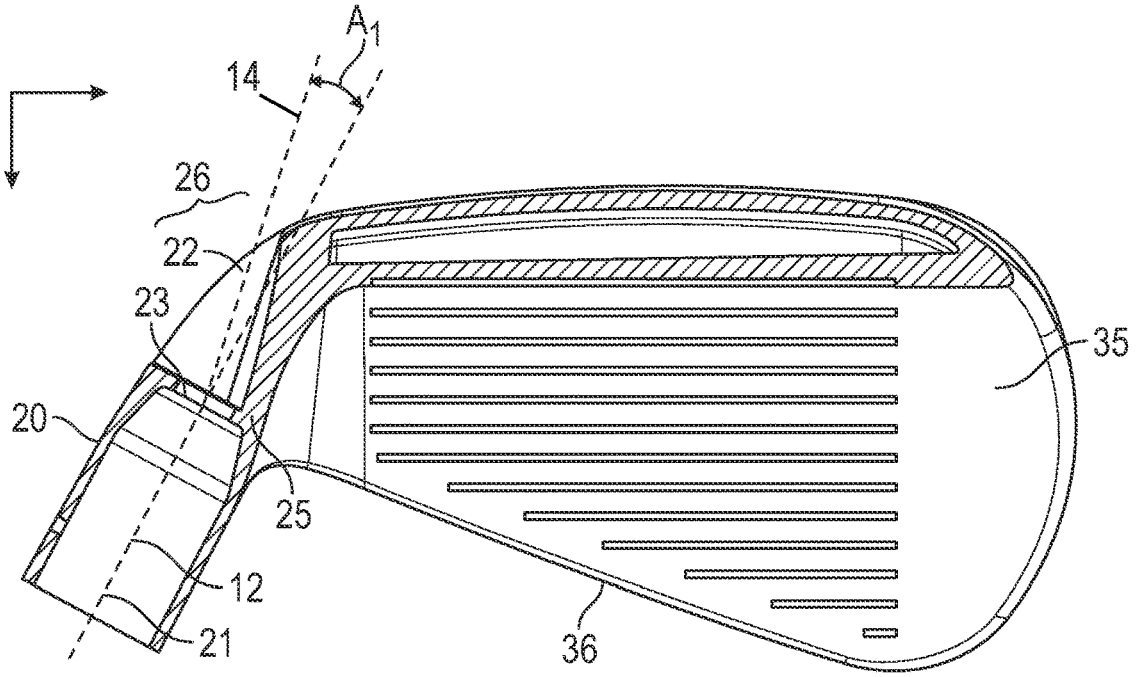
FIG. 6 is a cross-sectional view of the embodiment shown in FIG. 4 taken along lines 6-6.
Figure 7:
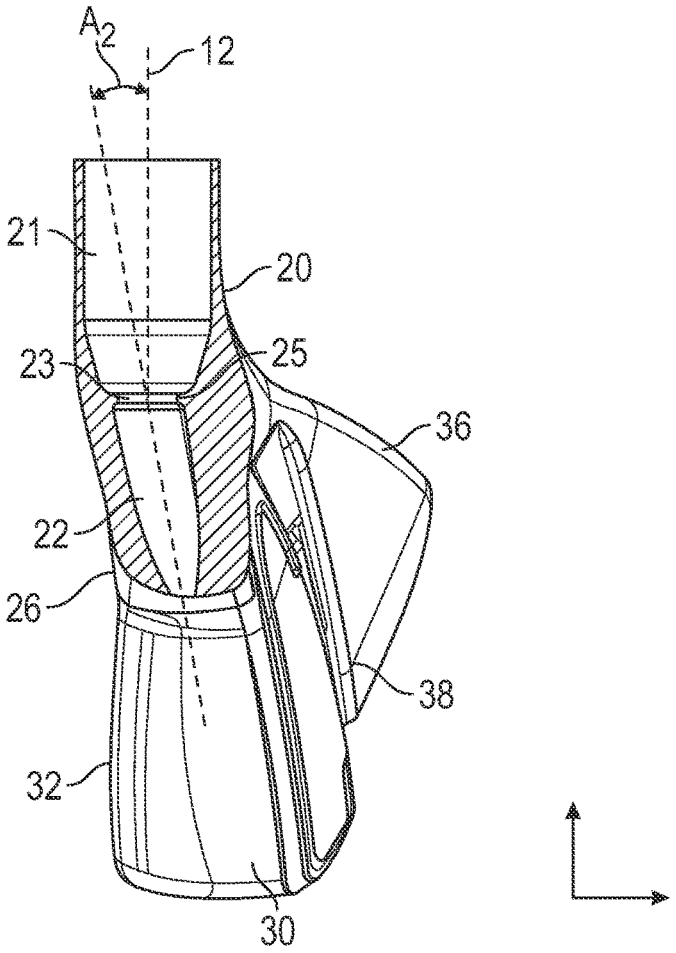
FIG. 7 is a cross-sectional view of the embodiment shown in FIG. 4 taken along lines 7-7.
Figure 8:
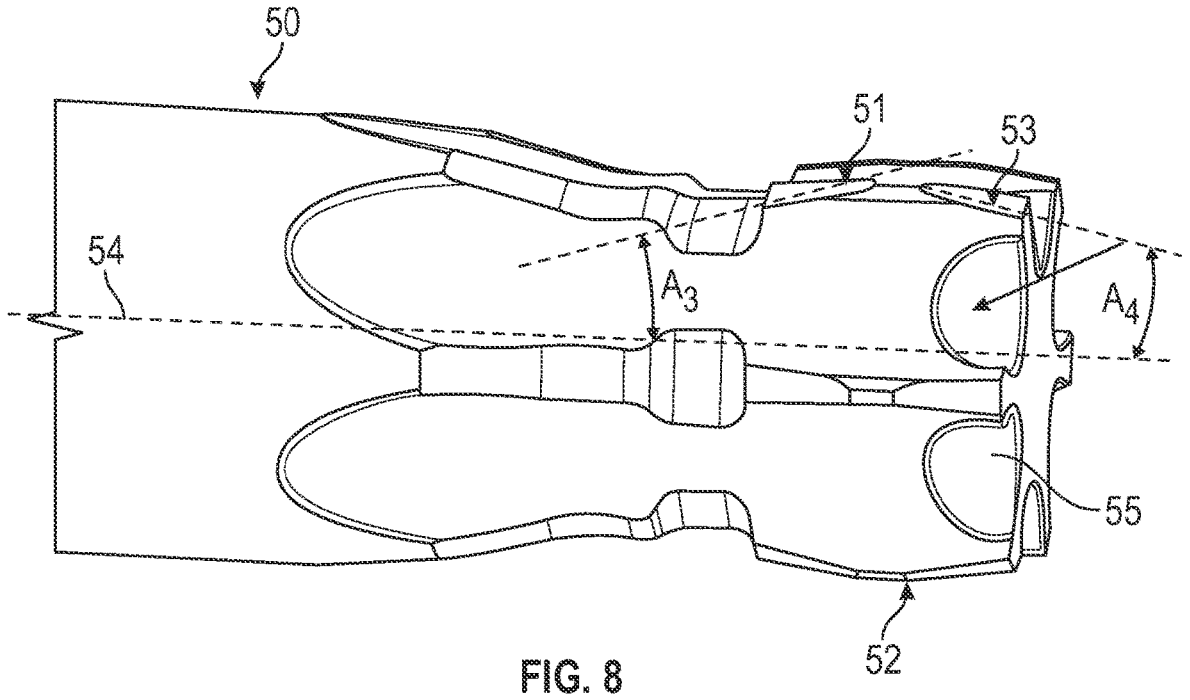
FIG. 8 is a side perspective view of an adjustment tool sized to engage with the golf club head shown in FIGS. 4-7.
Figure 9:
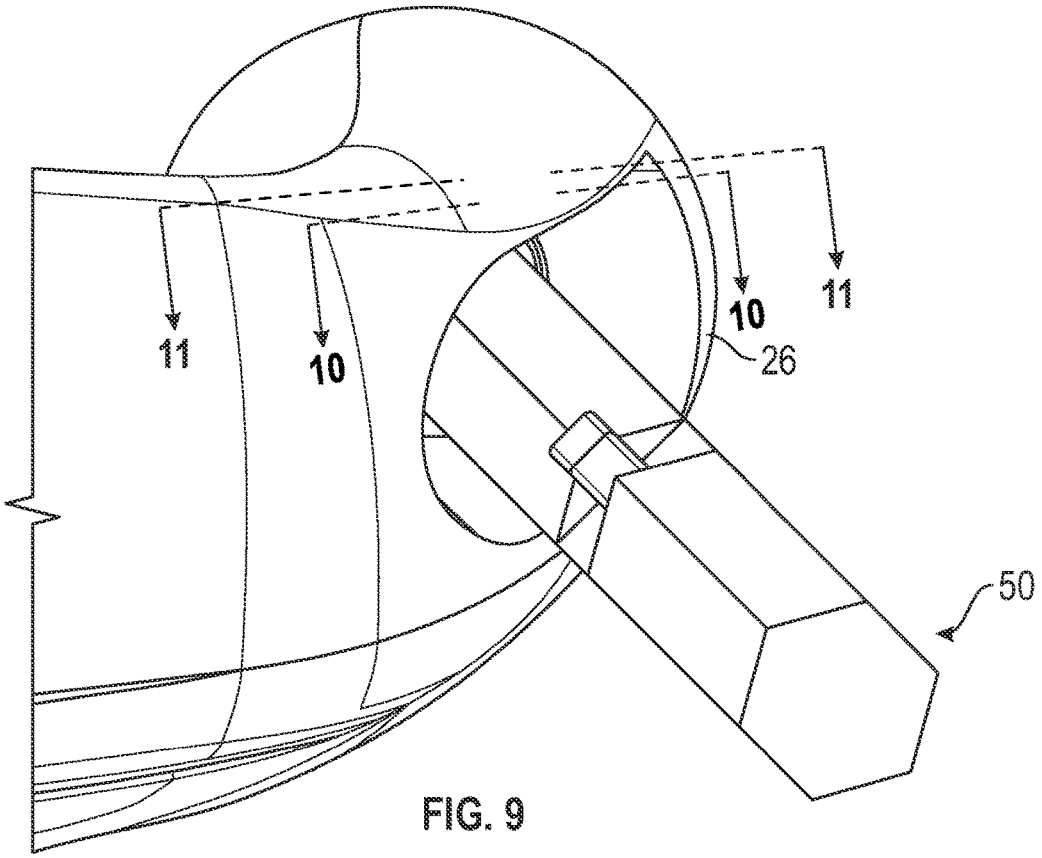
FIG. 9 is a sole perspective view of the tool shown in FIG. 8 engaged with the embodiment shown in FIG. 5.
Figure 10:
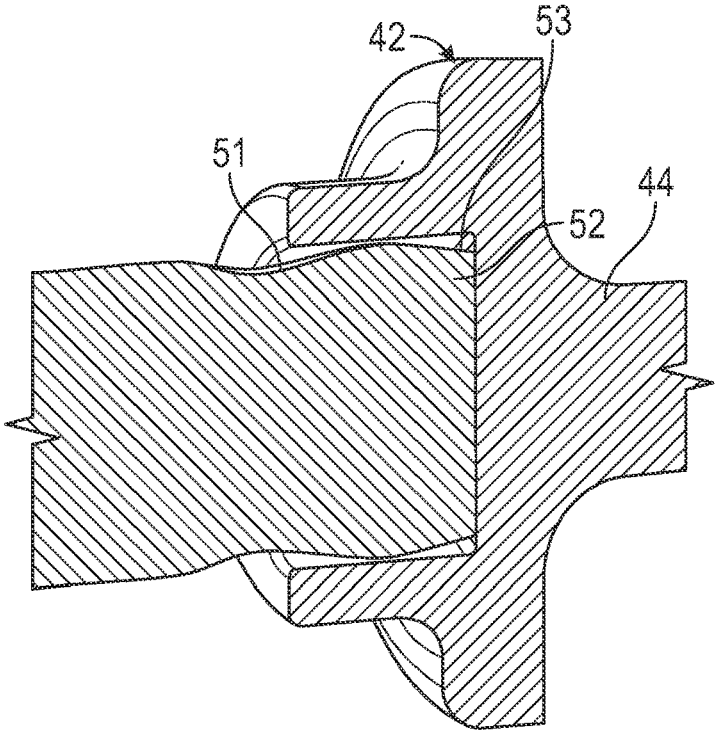
FIG. 10 is a cross-sectional view of the embodiment shown in FIG. 9 taken along lines 10-10.
Figure 11:
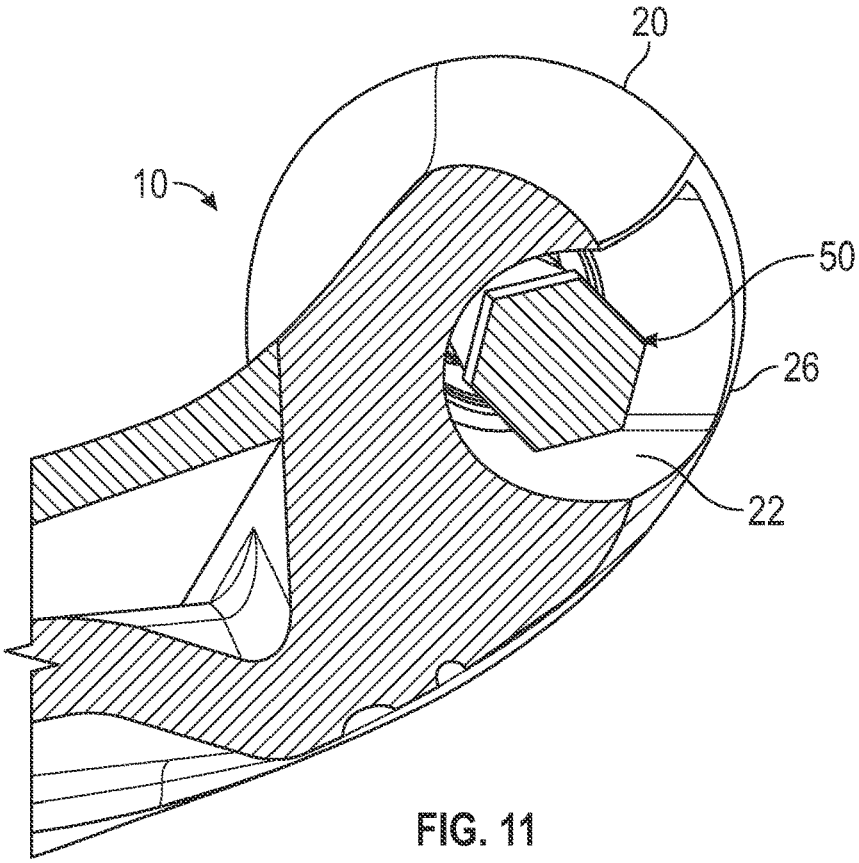
FIG. 11 is a cross-sectional view of the embodiment shown in FIG. 9 taken along lines 11-11.

Unlike the exit channels of prior art designs, the exit channel 22 of the present invention has an axis 14 extending at an angle $A_1$ of up to 15 degrees measured along a heel-toe direction from the hosel axis 12 (lie direction) and at an angle $A_2$ of up to 15 degrees measured along a front-back direction from the hosel axis 12 (loft direction), as shown in FIGS. 6 and 7. In the preferred embodiment, $A_1$ and $A_2$ are each approximately 10 degrees. When a mechanical fastener 40 is engaged with an adjustable hosel assembly such that the head 42 of the fastener 40 is disposed within the exit channel 22 and abuts the flange 25 and the elongated body 44 of the fastener extends into the hosel bore 21, a tool 50 with a head 52 that is customized to match the engagement features of the fastener head 42 can be inserted into the channel 22 without interference from other parts of the iron head 10. The tool head 52 preferably has a hexagonal shape with edges 51, 53 with angles $A_3$, $A_4$ of up to 15 degrees measured with respect to a tool axis 54 and relief cuts 55 to maximize surface contact with the fastener head 42.

The angled exit channel 22 of the present invention allows for a more attractive finished club head 10 than would be created from combining prior art adjustable hosel designs with iron club heads 10, as the exit channel 26 is confined to the heel section 26 without extending into the sole 30, leading edge 32, or face 35. This configuration also allows for enough points of hosel adjustability that a single head 10 can be used for fitting purposes. This head 10 can be used in play or as a fitting device to help golfers select irons with suitable loft and lie angles. In other embodiments, the angled exit channel 22 of the present invention may be used in wedges.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications, combinations, and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. An iron-type golf club head comprising:

a hosel comprising a hosel bore, a through hole, and a hosel axis;

a face;

a topline;

a sole; and a heel section comprising an exit channel, wherein the exit channel comprises a channel axis, wherein the exit channel is in communication with the through hole and the hosel bore, and wherein the channel axis extends at an angle $A_1$ of 1 to 15 degrees measured along a heel-toe direction from the hosel axis 12 (lie direction) and at an angle $A_2$ of 1 to 15 degrees measured along a front-back direction from the hosel axis 12 (loft direction);

wherein the exit channel does not extend into the sole or the face.

2. The iron-type golf club head of claim 1, wherein the iron-type golf club head is selected from the group consisting of a wedge, a blade iron, a hollow iron, and a cavity-back iron.

* * * * *